US005953288A

United States Patent [19]

Chappell

[11] Patent Number: 5,953,288

[45] Date of Patent: Sep. 14, 1999

[54] CONTAINER FOR MEDICATION

[76] Inventor: Martin N. Chappell, 820 Park Row, Suite 632, Salinas, Calif. 93901

[21] Appl. No.: 09/076,590

[22] Filed: May 12, 1998

Related U.S. Application Data

[63] Continuation-in-part of application No. 08/592,758, Jan. 26, 1996, Pat. No. 5,751,660, and a continuation-in-part of application No. 29/049,523, Jan. 26, 1996, abandoned.

[51] Int. Cl.[6] ..... G04B 47/00; B65D 51/18; G07F 11/00

[52] U.S. Cl. ..... 368/10; 215/230; 215/386; 221/2

[58] Field of Search ..... 368/10, 278; 206/534; 215/230, 256, 386; 221/2, 15

[56] References Cited

U.S. PATENT DOCUMENTS

| | | | |
|---|---|---|---|
| D. 23,381 | 6/1894 | Tatum . | |
| D. 36,480 | 8/1903 | Gordon . | |
| D. 117,266 | 10/1939 | Gerhart . | |
| D. 213,690 | 4/1969 | Eckstrom . | |
| 217,926 | 7/1879 | Carter . | |
| D. 264,937 | 6/1982 | Groark | D9/349 |
| 267,924 | 11/1882 | Paull . | |
| D. 358,985 | 6/1995 | Rubin | D9/341 |
| 2,538,684 | 1/1951 | Gushard et al. | 215/1 |
| 4,419,016 | 12/1983 | Zoltan | 368/10 |
| 4,586,622 | 5/1986 | Walldorf | 215/256 |
| 4,939,705 | 7/1990 | Hamilton et al. | 368/10 |
| 4,986,429 | 1/1991 | Singleton, Jr. | 215/230 |
| 5,170,380 | 12/1992 | Howard et al. | 368/10 |
| 5,210,431 | 4/1993 | Berger et al. | 215/100 R |
| 5,332,112 | 7/1994 | Blocker | 216/6 |
| 5,433,324 | 7/1995 | Leonard | 206/534 |
| 5,495,961 | 3/1996 | Maestre | 221/3 |

OTHER PUBLICATIONS

Cole–Parmer Instrument Company Catalog 1991–1992, p. 702, item d, the Fernbach culture flask.

*Primary Examiner*—Vit Miska
*Attorney, Agent, or Firm*—Thomas Schneck

[57] ABSTRACT

A container for drugs which features a cylindrical vial with a cylindrical skirt joined to a base unit housing a timer unit with a time display. A switch sets a time which remains on display, indicating the last time the switch was actuated, i.e. the last time medication was taken. The base unit is removably mounted to the vial with a ball and socket arrangement so that the base unit may be retained, even though the vial is discarded.

4 Claims, 1 Drawing Sheet

CONTAINER FOR MEDICATION

CROSS-REFERENCE TO RELATED APPLICATION

This application is a continuation-in-part of prior applications Ser. No. 08/592,758 filed Jan., 26, 1996, now U.S. Pat. No. 5,751,660 granted May 12, 1998, and a continuation-in-part of Ser. No. 29/049,523 filed Jan. 26, 1996, now abandoned.

TECHNICAL FIELD

The invention relates to containers for drugs and more particularly to containers for medication combined with a timer.

BACKGROUND ART

There are many drugs sold today which contain ingredients which are toxins if taken in large doses. Such drugs are commonly used in coronary care and chemotherapy, as well as the treatment of AIDS and other illnesses. In most instances warning labels are placed on the bottles by pharmacists and patients are instructed to carefully monitor dosages. However, with the increase in mail order delivery of prescriptions there is a need to heighten a patient's awareness that certain medications must be carefully administered.

Many patients often take a large number of medications, often prescribed for different intervals. Some of these medications are of little consequence if taken to frequently, but others can be dangerous. Patients can easily become confused regarding whether any particular medication has been taken and whether the doubtful medication is one that can be harmful.

Sometimes aged patients have trouble reading or understanding labels and so are not aware of any particular danger with a drug. This is often true of patients having the greatest need for strong medication.

Another problem is that many patients have difficulty remembering the time of their last dose. Bottles are clearly labeled with dosages but frequently a wrong dosage occurs because a patient cannot remember whether a medication has been taken, often because the task is performed mechanically and does not register in the patient's awareness.

In U.S. Pat. No. 5,170,380 Howard et al. disclose a holding device for medication containers which provide a patient with the last time the medicine was taken by actuating a timer with a switch. The medication container is nested in a holder which sits in a base having timing circuits.

U.S. Pat. Nos. 4,419,016 and 4,939,705 both disclose pill bottles having closures which incorporate timing devices which remind the patient of the time for a dose. There are many other patents which deal with the same problem, many with sophisticated electronics which alert a user to the next time a dosage is to be taken.

Of particular concern is the risk associated with toxic doses, as well as providing reminders of the next dose. Timing considerations are critical in drug risk analysis because a patient who is not aware of his last dose can consume an overdose of a toxic drug. An object of the invention has been to provide a medication container which indicates the time of the last dose in a manner which may be incorporated into existing pill vials.

SUMMARY OF THE INVENTION

The above object has been achieved in a medication container, comparable in size and weight to conventional pill bottles, with a detachable base which houses a timer which displays the last time medication was taken. The base is intended to assist in carrying out a medication compliance program. The vial or container uses existing size caps and may be made with existing molding equipment modified for carrying the base unit described herein. A dimple in the top of the cap may seat a label which may be used to display dosing indicia. The vial, exclusive of the timer, is disposable, thereby reducing pill dust and miscellaneous particulate debris in reusable containers.

BEST MODE FOR CARRYING OUT THE INVENTION

Figure 1:
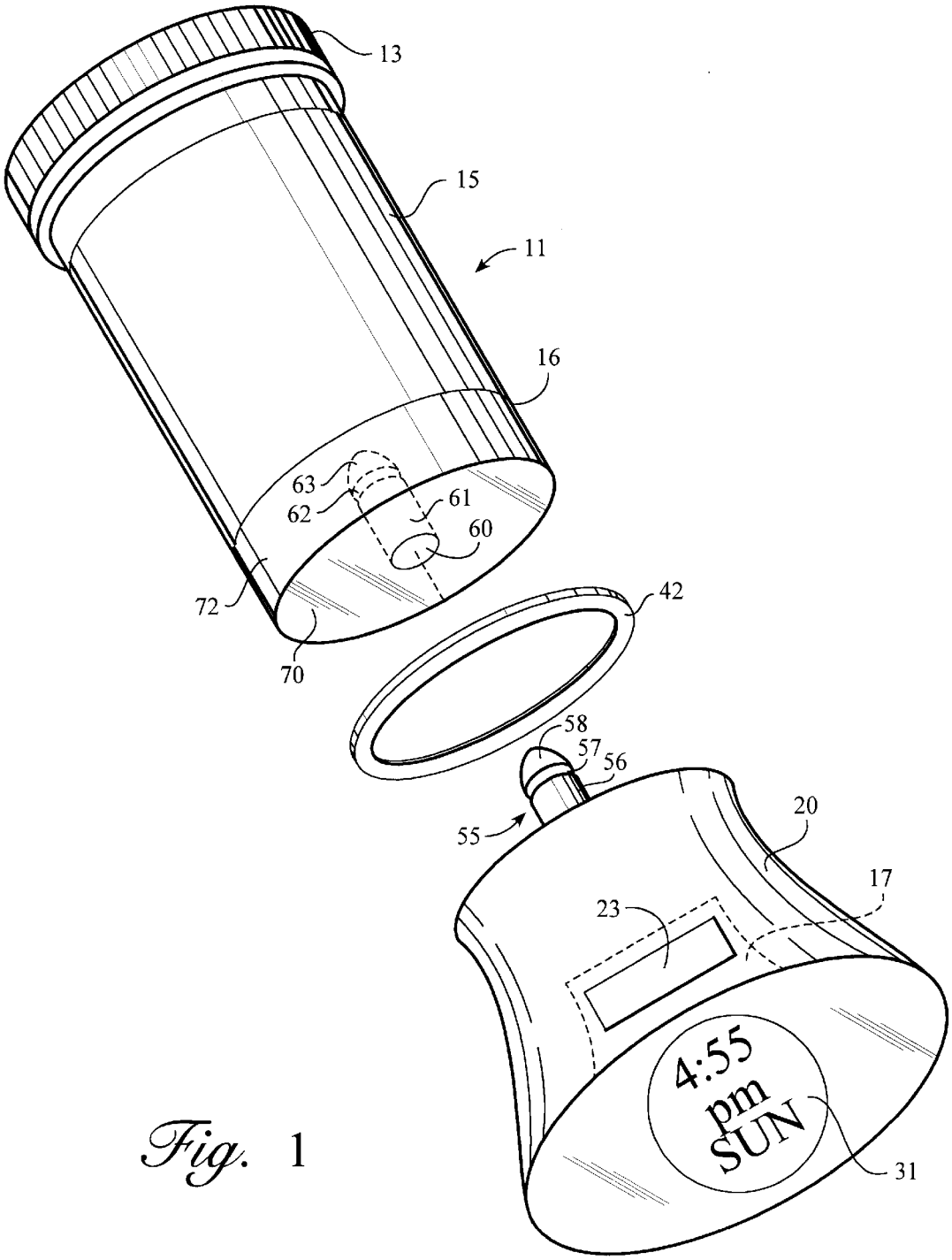
FIG. 1 is an exploded perspective view of the apparatus of the present invention.

With reference to FIG. 1, container 11 is a container for drugs in accord with the present invention. The container features a cylindrical vial 15 having a cap 13 and a solid bottom wall 16 which defines the lower storage volume of the hollow cylindrical vial 15. The size of the storage volume is comparable to common pill bottles. Below the bottom wall 16 is a lower detachable base unit 20 which is joined to the vial 15 which forms an upper unit, at bottom plate 70 of the vial. Bottom plate 70 caps annular skirt 72 that extends downwardly from solid bottom wall 16. Both the vial and lower unit are radially symmetric about the cylindrical axis of the vial. The lower unit flares outwardly for added stability. The extent of the outward flare is preferably between 0.5 to 3 cylindrical radii measured from the cylindrical wall to the furthest outward extent of the flare.

Annular skirt 72 extends downwardly from the edge of solid bottom wall 16 and is contiguous with cylindrical vial 15. Bottom plate 70 covers the end of annular skirt 72. Bottom wall 16, annular skirt 72 and bottom plate 70 define a hollow chamber in the bottom of vial 11. A socket 60 is located at the center of bottom plate 70. The socket extends upwardly into the hollow space defined by annular skirt 72. The socket extends upwardly from bottom plate 70 initially with a cylindrical tube 61 that narrows at a neck 62 before expanding to hemisphere 63.

Vial 11 is removably attached to base unit 20 by shaft 55 that fits into socket 60. The shaft is comprised of a cylindrical length 56 that narrows at neck 57 then expands again into head 58. This head 58 is split to allow for compression through socket neck 62 before expanding into hemisphere 63. Shaft 55 securely holds together vial 11 and base 20. An optional washer 42 may be used to prevent moisture or dirt from entering the space between the vial and the base.

The push button 23 is pushed to latch the current time maintained by timer unit 17. The timer unit is continuously running and internally maintains the current time. Optionally, the timer may be provided with a memory to store the latched times for later retrieval by a medical overseer. The timer unit has a digital watch movement, powered by a compact lithium battery, operating an LCD display 31. However, the only time which is displayed is the time latched or "stamped" as a reminder of the last dose taken when the push button 23 is depressed. Auditory feedback, such as a beep, can be provided by an oscillator and miniature speaker associated with the push button. Latch circuits are common in timers. Auditory feedback confirms that the push button has been pushed and the time latched and displayed.

The two-piece construction shown in FIG. 1 allows a user to retain the lower detachable unit 20, with a timer, and only purchase the cylindrical vial 15 as needed. The upper cylindrical vial 15 is disposable, but the lower detachable base unit 20 is retained for reuse with other upper portions. The cylindrical vial 15, as well as the lower detachable base unit 20 are made of polycarbonate which is optically clear, but usually dyed dark to filter light which might cause degradation of medications. Other plastic materials, particularly opaque materials, could be used. Existing vials can be adapted to use the present invention by adhering the annular skirt 72 to a standard cylindrical vial.

The time display, facing away from bottom wall 16, allows a user to turn the bottle upside down to view the last time the push button 23 was depressed, presumably the last time that the medication container was opened. The time display could also be placed in a manner to be visible through skirt 27.

The distinctive outwardly flared shape of the base unit 20 may serve as a distinctive warning of a strong or toxic medication.

I claim:

1. A finger held bottle for medication subject to strict compliance comprising, a cylindrical vial having a removable cap and a circumferential wall, said vial being formed of upper and lower portions, the upper portion including a closed bottom wall and an annular skirt below said bottom wall, said annular skirt having a bottom plate at a lower edge of the skirt, said bottom plate having a centrally located socket;

a base unit housing a time and date stamp timer removably joined to the lower portion of the vial and having a visible display and a manually actuated switch for causing a time and date to be displayed on the display as a date and time stamp until the next time the switch is actuated; a shaft, mounted on said housing projecting into said socket, whereby the vial is securely but removably held on the base unit.

2. The apparatus of claim 1 wherein the shaft includes a knob fitting into said socket.

3. The apparatus of claim 1 wherein said cap has a shallow dimple for seating an information bearing wafer.

4. The apparatus of claim 1 wherein the base unit housing has an outwardly flared profile relative to the cylindrical vial.

* * * * *